US005274298A

United States Patent [19]

Cassidy et al.

[11] Patent Number: 5,274,298

[45] Date of Patent: Dec. 28, 1993

[54] SPARK PLUG HAVING AN ABLATIVE COATING FOR ANTICONTAMINAT FOULING

[75] Inventors: Donald J. Cassidy, Fairfield Glade, Tenn.; Barbara N. Juterbock, Plymouth, Mich.

[73] Assignee: Ford Motor Company, Dearborn, Mich.

[21] Appl. No.: 811,605

[22] Filed: Dec. 23, 1991

[51] Int. Cl.[5] ..... H01T 13/00; H01T 13/14

[52] U.S. Cl. ..... 313/143; 313/127; 313/137; 123/169 CL

[58] Field of Search ..... 313/127, 137, 143, 352, 313/355; 123/169 R, 169 CL, 169 P

[56] References Cited

U.S. PATENT DOCUMENTS

| | | | |
|---|---|---|---|
| 3,345,532 | 10/1967 | Mattarella | 313/143 |
| 3,365,605 | 1/1968 | Linstedt | 313/137 |
| 4,250,426 | 2/1981 | Nakajima et al. | 313/143 |
| 4,267,483 | 5/1981 | Nakajima et al. | 313/143 |
| 4,415,828 | 11/1983 | Mizuno et al. | 313/118 |
| 4,914,344 | 4/1990 | Watanabe et al. | 313/141 |
| 4,937,484 | 6/1990 | Ishino | 313/143 |

FOREIGN PATENT DOCUMENTS

| | | | |
|---|---|---|---|
| 0023840 | 2/1979 | Japan | 313/127 |
| 0057038 | 5/1979 | Japan | 313/137 |

*Primary Examiner*—Donald J. Yusko
*Assistant Examiner*—Nimesh Patel
*Attorney, Agent, or Firm*—Roger L. May; Lorraine S. Melotik

[57] ABSTRACT

A spark plug is provided for an internal combustion engine and includes a center electrode having a combustion chamber end and a ceramic insulator having an end portion over which an ablative coating is formed for removing contaminants deposited thereon. The ablative coating is capable of ablating completely during sustained operation of the spark plug.

18 Claims, 1 Drawing Sheet

SPARK PLUG HAVING AN ABLATIVE COATING FOR ANTICONTAMINAT FOULING

BACKGROUND OF THE INVENTION

The present invention generally relates to an improved spark plug for an internal combustion engine, and more particularly, to a spark plug having an ablative coating deposited on the end portion of its ceramic insulator which ablates to remove contaminants which are deposited thereon prior to sustained use or firing of the spark plug.

During an initial period of time prior to when an internal combustion vehicle, such as a car or truck, is sold to a user, the vehicle engine is repeatedly subjected to conditioning running and/or short-time running during which low speed and low loads are experienced. For example, transporting the vehicle from the factory to a dealer involves loading and unloading the vehicle onto and from a truck requiring operation of the vehicle for only short distances and time intervals. Typically, spark plugs used in internal combustion engines include a ceramic insulator having an end portion exposed to the interior chamber of the engine. This end portion or tip of the ceramic insulator can become contaminated with a wide variety of substances, such as carbon or soot, which interfere with the operation of the spark plug in that the spark plug has difficulty in producing a strong spark. The spark plug is extremely susceptible to such contamination during the initial life of the vehicle. Such effects are even more prevalent when the vehicle is subjected to cold climates. In order to guard against this type of contaminative damage, heat-resistant insulating materials have been deposited on the surface of the end portion or tip of the ceramic insulator which is exposed to the interior of the combustion engine with a view toward preventing leakage of current from the surface of the ceramic insulator end portion to the metal housing of the spark plug.

Past attempts in the art provide coatings which are durable, permanent and designed to survive the life of the spark plug. For example, Ishino, U.S. Pat. No. 4,937,484, discloses a heat-resistant coating for application to the end portion of the ceramic insulator. The coating is formed of a solution of silicone oil, paraffin and ozokerite combined in a manner which increases the coating's viscosity. Such a coating is clearly designed to be permanent and durable, so as to prevent contaminants such as carbon or soot from fouling or otherwise interfering with the sparking capabilities of the spark plug.

The problem experienced with spark plugs having such permanent and durable coatings, however, is that the coatings have a tendency to increase the temperature of the end portion or tip of the spark plug beyond the range for which the spark plug was designed. This is especially prevalent during later usage of the vehicle and at high vehicular speeds. Thus, it would be desirable to have a spark plug which resists contaminant fouling during the initial life of the vehicle, yet does not interfere or inhibit performance of the spark plug during later or sustained use.

Accordingly, there is a need in the art for a spark plug which resists contaminant fouling during the initial life of the spark plug, thereby improving the operation of the vehicle. There is also a need in the art for such a spark plug which does not interfere with or inhibit performance during later or sustained operation of the vehicle.

SUMMARY OF THE INVENTION

The present invention meets the aforementioned needs in the art by providing a spark plug which prevents contaminant fouling during its initial life and does not interfere with or inhibit performance of the spark plug during later use. As a result of using the spark plug in accordance with the invention, misstarts of an internal combustion engine are prevented prior to sustained operation thereof. The invention provides such advantages by incorporating an ablative coating on the ceramic insulator end portion or tip of the spark plug. As used herein, the term ablative coating is defined as a coating or material in which the surface layer is continually removed by cracking or otherwise breaking down during vehicle operation. The present spark plugs may find utility in a wide variety of vehicles, such as cars and trucks, or in any equipment using an internal combustion engine.

In accordance with one aspect of the invention, a spark plug for an internal combustion engine is provided. The spark plug comprises a center electrode having an end which faces a combustion chamber, and surrounded by a ceramic insulator having an end portion over which an ablative coating is formed for removing contaminants deposited thereon. The center electrode is substantially enclosed within the ceramic insulator such that the end facing the combustion chamber extends outwardly from the end portion of the insulator. The spark plug further comprises a metal housing within which the end portion of the ceramic insulator is enclosed, and a ground electrode extends from the metal housing to the end of the center electrode facing the combustion chamber to define a spark gap between the ground electrode and the end of the center electrode.

The invention also provides a spark plug for an internal combustion engine having a similar structural design as the spark plug described above. More particularly, the spark plug comprises a center electrode having an end which faces a combustion chamber and a ceramic insulator having an end portion over which an ablative coating is formed for removing contaminants deposited thereon. The ablative coating includes a solid suspension material interdispersed in a binder material wherein the solid suspension material is selected from the group consisting of kaolin, ball clay, bentonite, quartz, zirconia and combinations thereof while the binder material is selected from the group consisting of colloidal silica, colloidal alumina, methyl cellulose, polyvinyl alcohol and combinations thereof. The center electrode is substantially enclosed within the ceramic insulator such that the end facing the combustion chamber extends outwardly from the end portion of the ceramic insulator. Additionally, the spark plug is provided with a metal housing within which the end portion of the ceramic insulator is enclosed, and a ground electrode extends from the metal housing to the end of the center electrode to define a spark gap between the ground electrode and the end of the center electrode facing the combustion chamber.

In yet another aspect of the present invention, a method for preventing misstarts of an internal combustion engine prior to sustained operation thereof is provided. The method comprises the step of coating an end of a ceramic insulator in a spark plug with an ablative coating. Thereafter, the spark plug is mounted into the internal combustion engine. The spark plug is ignited by starting the internal combustion engine for predetermined short time intervals so as to ablate the ablative coating prior to sustained operation of the internal combustion engine. As a result, misstarts of the vehicle during its initial operational life to which the internal combustion engine is attached are minimized as carbon, soot, and other contaminants which would otherwise build up on the spark plug are ablated along with portions of the ablative coating during the period of initial operation of the engine. Later, during post-delivery sustained operation of the vehicle, the coating completely ablates, permitting operation of the spark plug under designed conditions.

Accordingly, it an object of the present invention to provide a spark plug which prevents contaminant fouling during the initial life of the vehicle; to provide a spark plug for a vehicle which does not interfere with or inhibit performance of the spark plug under the conditions for which it was designed; and, to provide a method for preventing misstarts of an internal combustion engine prior to sustained operation thereof. Other objects and advantages of the invention will be apparent from the following detailed description, the accompanying drawings and the appended claims.

DETAILED DESCRIPTION OF THE PREFERRED EMBODIMENT

Figure 1:
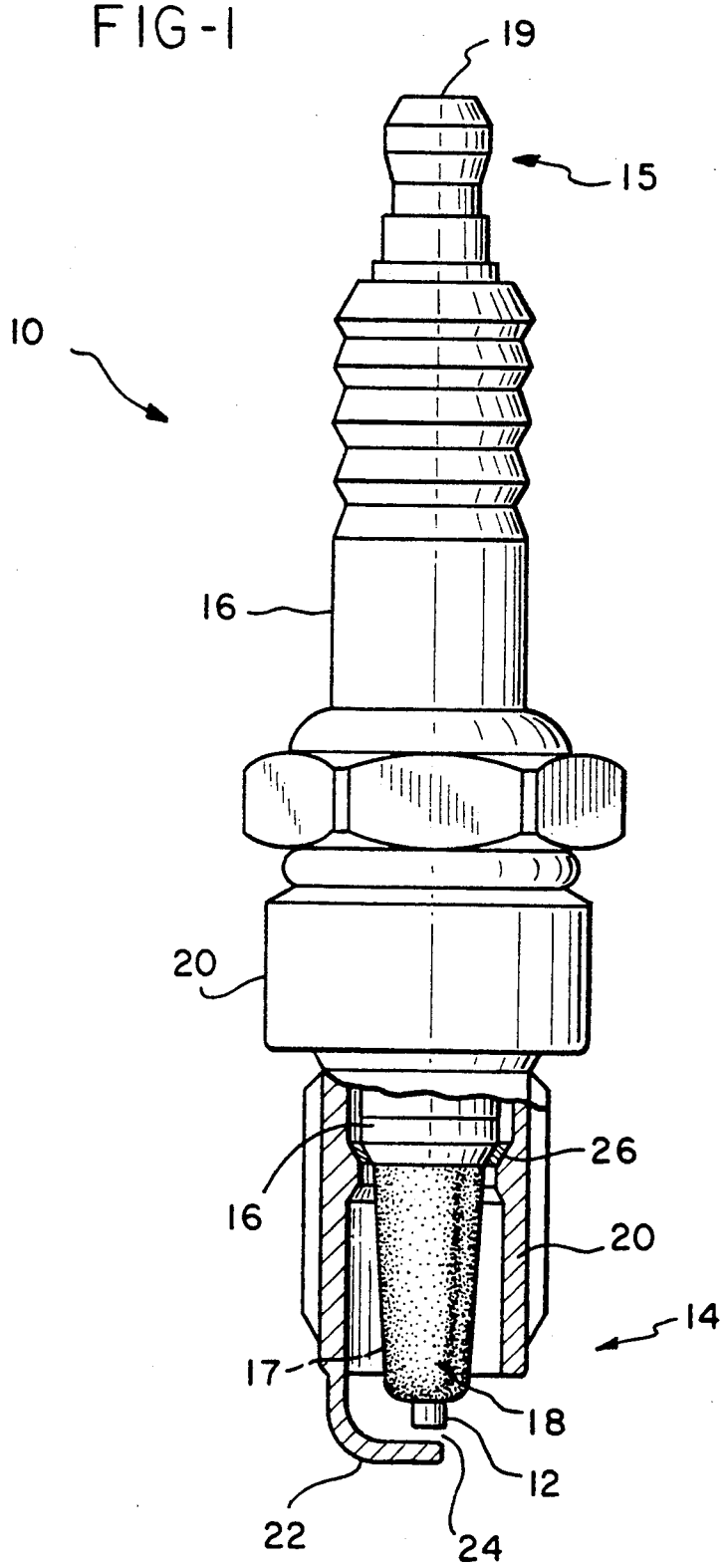
FIG. 1 is a side elevation view of the spark plug in accordance with the invention, wherein the end portion of the spark plug s shown in cross-section.

Reference is now made to FIG. 1 which illustrates the spark plug 10 in accordance with the present invention. As mentioned previously, an ablative coating 18 on spark plug 10 of the present invention prevents contaminant fouling during the initial life of a vehicle at which time the vehicle is operated for short time intervals over minimal distances. Additionally, ablative coating 18 does not interfere or inhibit performance of the spark plug 10 when it is used continuously for extended periods of time as the coating ablates completely after a short time. The use of the spark plug 10 with ablative coating 18 also prevents misstarts of the vehicle's internal combustion engine prior to sustained operation thereof. Typically, the present spark plug 10 will be incorporated into cars and trucks, but may also find utility in other apparatus having internal combustion engines, such as lawn mowers and earth-moving equipment which experience similar contaminant fouling problems especially during their initial periods of operation.

Spark plug 10 and its individual components include a combustion chamber end generally designated by reference numeral 14 and a contact end 15 to which the spark plug wires are attached. In addition, spark plug 10 comprises a center electrode 12 and a ceramic insulator 16 having an end portion 17 over which ablative coating 18 is formed for removing contaminants deposited thereon. As seen in FIG. 1, the center electrode 12 is substantially enclosed within ceramic insulator 16 such that the chamber end 14 of center electrode 12 extends outwardly from end portion 17 of ceramic insulator 16. The contact end 15 of center electrode 12 is connected to a metal upper electrode 19 to which the spark plug wires (not shown) are directly attached. Spark plug 10 further comprises a metal housing 20 within which the end portion 17 of ceramic insulator 16 is substantially enclosed. Furthermore, FIG. 1 shows a ground electrode 22 extending from the metal housing 20 to the chamber end 14 of center electrode 12 to define a spark gap 24 between the ground electrode 22 and the chamber end 14 of center electrode 12. Thus, as those skilled in the art will appreciate, spark plug 10 has a conventional design for use in a variety of internal combustion engines.

As illustrated in FIG. 1, center electrode 12 is substantially enclosed within ceramic insulator 16 such that its chamber end 14 extends outwardly from the end portion 17 of ceramic insulator 16. Spark plug 10 is provided with metal housing 20 within which the end portion 17 of ceramic insulator 16 is enclosed and it is in this region where contaminants such as soot and carbon are most often deposited. The metal housing 20 is secured in this manner by a gasket 26 or other similar packing material which is well known in the art. As seen in FIG. 1, ceramic insulator 16 extends through metal housing 20 substantially enclosing the entire length of center electrode 12 ultimately terminating at upper electrode 19 to which a spark plug wire may be attached. While those skilled in the art will appreciate the rather typical structural design of the spark plug 10 illustrated in FIG. 1, it should be understood that the ablative coating 18 of the present invention may be incorporated into spark plugs having other designs without departing from the scope of the invention.

As alluded to previously, ablative coating 18 is incorporated into spark plug 10 for the purpose of removing contaminants deposited on the end portion 17 of ceramic insulator 16. Ablative coating 18 provides a viable solution for the long-standing problem of contaminant or soot deposition in spark plugs prior to sustained use or firing thereof. Those skilled in the art are well aware that it is the end portion 17 of ceramic insulator 16 which acts as a depository for contaminants, such as carbon and other types of soot, all of which interfere with the operation of the spark plug 10. As contaminants are formed over the end portion 17, the current or charge propagating through the center electrode 12 in spark plug 10 tends to flow and dissipate across the surface of ceramic insulator 16. The flow of current is affected in this manner since the current tends to follow the path of least resistance which will be through the contaminants formed on the end portion 17 of ceramic insulator 16. This occurrence is attributed to the contaminants since they typically comprise carbon and the like which are conductive in nature. As a result, the current does not propagate across the spark gap 24 to the ground electrode 22 to produce a strong spark. Such an undesirable phenomena is well known in the art.

In accordance with the invention, ablative coating 18 possesses the capability of ablating or being continually evaporated, cracked or otherwise broken down such that any contaminants which are deposited on the end portion 17 of the ceramic insulator 16 will be removed, as well, along with the ablative coating. In this way, contaminant or soot deposition, a problem especially prevalent prior to sustained use, can be eliminated relatively rapidly during the initial use of spark plug 10. Spark plug 10 of the invention finds exceptional utility in cars and trucks immediately after manufacture in that they remain in transit and on dealer's lots and may be exposed to harsh climates for extended periods of time prior to sustained use. During such idle time periods where the engines may be run only for very short periods such as when the automobile is loaded and unloaded from the automobile carriers, the spark plugs in the automobiles are especially susceptible to carbon and soot deposition. Such contaminants cause misstarts of the automobile engine, especially during the engine break-in period after sale to a consumer thereby increasing warranty expenses. It is during these short operation periods and during the initial engine break in period when the contaminants are ablated from ceramic insulator 16, ultimately resulting in a contaminant-free spark plug when the automobile is operated for sustained periods.

Ablative coating 18 may be deposited onto the ceramic insulator 16 by any suitable means, such as by dipping techniques or by spray coating techniques. The relative thickness of ablative coating 18 will depend upon the particular application for spark plug 10. For example, a truck may have longer idle times prior to sustained use as compared to a car, thereby requiring a greater thickness of the ablative coating. Generally, however, it is preferable for ablative coating 18 to have a thickness in a range from about 100 microns to about 1000 microns. More preferably, ablative coating 18 will have a thickness in a range from about 100 microns to about 250 microns. It is preferable for ablative coating 18 to remain on the ceramic insulator 16, especially at the end portion 17 where most of the carbon soot and/or other contaminants are deposited, until the car or truck is operated for sustained periods, i.e., sold to a consumer. It should be understood that ablative coating 18 should have a melting point which withstands the temperatures of the environment in which it operates. To this end, it is preferable for ablative coating 18 to have a melting point which is greater than about 980° C., which is the approximate operating temperature of most internal combustion engines such as those found in most automobiles.

Ablative coating 18 preferably includes a solid suspension material interdispersed in a binder material. Any water found in the ablative coating 18 is evaporated from spark plug 10 by heating or other known techniques. Ablative coating 18 is formed from an aqueous mixture. In that regard, ablative coating 18 preferably is applied as an aqueous mixture including a solid suspension material in an amount from about 65% to about 75% by weight; a binder material in an amount from about 0.17% to about 4.4% by weight; and the balance water. Most preferably, ablative coating 18 which is applied comprises an aqueous mixture including a solid suspension material in an amount from about 65% to about 67% by weight; a binder material in an amount from about 0.7% to about 0.9% by weight; and the balance water. It should be understood that deviations from the aforementioned ranges are possible without departing from the scope of the invention.

Preferably, the solid suspension material is selected from the group consisting of kaolin, ball clay, bentonite, quartz, zirconia and combinations thereof. As those skilled in the art will appreciate, certain ceramics such as quartz undergo polymorphic inversions accompanied by volume changes resulting in surface cracking and breakdown of the coating as it is heated and cooled during short operating intervals. Materials having such characteristics are especially suitable in accordance with the invention since they enhance the ablative nature of ablative coating 18.

The binder material is preferably selected from the group consisting of colloidal silica, colloidal alumina, methyl cellulose, polyvinyl alcohol and combinations thereof. The binder material serves as the media within which the solid suspension material may be bound together. It has been found that an aqueous mixture of the suspension material and the binder material produce a coating comporting with the aim of ablative coating 18 in that the coating will ablate or evaporate to the extent necessary to remove surface deposited contaminants prior to sustained use of spark plug 10. Those skilled in the art should appreciate that while the aforementioned binder and suspension materials are preferred, other materials having the required ablative characteristics may be used without departing from the scope of the invention.

For purposes of facilitating the ablative characteristics of preferred ablative coating 18, it is preferable to have the solid suspension material formed of finely divided grains having a diameter in a range from about 100 microns to about 200 microns. In this form, the solid suspension material enhances the capability of ablative coating 18 to ablate completely during sustained use of spark plug 10. As discussed previously, this is particularly advantageous over those anticontaminant or antifouling coatings used in the past which were more permanent in nature. Such permanent coatings tended to inhibit performance of the spark plugs in that the spark plugs did not operate under conditions for which they were designed (i.e., without the presence of such coatings). To the contrary, ablative coating 18 of the present invention ablates completely during sustained use leaving spark plug 10 in its original design, thereby allowing spark plug 10 to operate under conditions for which it was designed.

The present invention also contemplates enhancing the ablative characteristics of ablative coating 18 by providing ablative coating 18 with a first coefficient of thermal expansion and ceramic insulator 16 with a second coefficient of thermal expansion, wherein the coefficient of ablative coating 18 is larger than the coefficient of ceramic insulator 16. This mismatch in coefficients of thermal expansion causes ceramic insulator 16 and ablative coating 18 to expand at different rates, thereby promoting coating cracking and breakdown. Consequently, the ablation of ablative coating 18 is facilitated. Alternatively, the ablative coating 18 may be provided with a coefficient of thermal expansion which is smaller than the coefficient of thermal expansion of the ceramic insulator 16. Thus, any difference in the thermal coefficient of expansion between ablative coating 18 and ceramic insulator 16 will result in an enhancement of ablative characteristics of ablative coating 18. The particular coefficient of thermal expansion will depend upon the specific materials used in the ablative coating 18 and the ceramic insulator 16 and may be chosen to provide the aforementioned mismatch.

In yet another aspect of the present invention, a method for preventing misstarts of an internal combustion engine prior to sustained operation thereof is provided. Initially, the method comprises the step of coating the end portion 17 of a ceramic insulator 16 in spark plug 10 with ablative coating 18. As discussed previously, this may be completed by any known spraying or dipping technique. The method also includes the steps of mounting spark plug 10 into the internal combustion engine of a vehicle and igniting spark plug 10 by starting the internal combustion engine for short time intervals so as to ablate the ablative coating 18 prior to sustained operation or the internal combustion engine.

As those skilled in the art will appreciate, the short time intervals will vary depending upon the particular application of the spark plug 10. For example, in the case of a new automobile being transported from the factory assembly line to the consumer, the short time intervals correspond to those operational time intervals experienced while the automobile is in transit from the manufacturer to the dealer. For example, the automobile must be driven from the assembly line to a storage lot, and then onto a carrier after which the automobile is driven from the carrier to the dealer's lot. In accordance with the invention, the present method contemplates using the preferred ablative coating 18 comprising the solid suspension material interdispersed in the binder material and water as described above. It should be understood that other steps known by those skilled in the art may be included with the present method to facilitate further the prevention of misstarts of internal combustion engines.

Having described the invention in detail and by reference to preferred embodiments thereof, it will be apparent that modifications and variations are possible without departing from the scope of the invention which is defined in the appended claims. For example, ablative coating 18 may comprise materials other than those described herein.

What is claimed is:

1. A spark plug for an internal combustion engine comprising:

a center electrode having an end which faces a combustion chamber;

a ceramic insulator having an end portion over which an ablative coating is formed for removing contaminants deposited thereon, said ablative coating comprising a solid suspension material interdispersed in a binder material, said center electrode being substantially enclosed within said ceramic insulator such that said end facing said combustion chamber extends outwardly from said end portion of said ceramic insulator;

a metal housing within which said end portion of said ceramic insulator is substantially enclosed; and a ground electrode extending from said metal housing to said end of said center electrode facing said combustion chamber to define a spark gap between said ground electrode and said end of said center electrode.

2. The spark plug as recited in claim 1 wherein said solid suspension material is selected from the group consisting of kaolin, ball clay, bentonite, quartz, zirconia and combinations thereof.

3. The spark plug as recited in claim 1 wherein said binder material is selected from the group consisting of colloidal silica, colloidal alumina, methyl cellulose, polyvinyl alcohol, and combinations thereof.

4. The spark plug as recited in claim 1 wherein said solid suspension material comprises finely divided grains having a diameter in a range from about 100 microns to about 200 microns.

5. The spark plug as recited in claim 1 wherein said ablative coating is formed from an aqueous mixture comprising:

a solid suspension material in an amount from about 65% to about 75% by weight;

a binder material in an amount from about 0.17% to about 4.4% by weight; and the balance water.

6. The spark plug as recited in claim 1 wherein said ablative coating has a first coefficient of thermal expansion and said ceramic insulator has a second coefficient of thermal expansion, said first coefficient being larger than said second coefficient so as to facilitate ablation of said ablative coating.

7. The spark plug as recited in claim 1 wherein said ablative coating has a first coefficient of thermal expansion and said ceramic insulator has a second coefficient of thermal expansion, said first coefficient being smaller than said second coefficient so as to facilitate ablation of said ablative coating.

8. The spark plug as recited in claim 1 wherein said ablative coating has a thickness in a range from about 100 microns to about 1000 microns.

9. The spark plug as recited in claim 1 wherein said ablative coating is formed from an aqueous mixture comprising:

a solid suspension material in an amount from about 65% to about 67% by weight;

a binder material in an amount from about 0.7% to about 0.9% by weight; and the balance water.

10. The spark plug as recited in claim 1 wherein said ablative coating has a melting point which is greater than about 980° C.

11. The spark plug for an internal combustion engine comprising:

a center electrode having an end which faces a combustion chamber;

a ceramic insulator having an end portion over which an ablative coating is formed for removing contaminants deposited thereon, said ablative coating including a solid suspension material interdispersed in a binder material, wherein said solid suspension material is selected from the group consisting of kaolin, ball clay, bentonite, quartz, zirconia and combinations thereof and said binder material is selected from the group consisting of colloidal silica, colloidal alumina, methyl cellulose, polyvinyl alcohol and combinations thereof, said center electrode being substantially enclosed within said ceramic insulator such that said end facing said combustion chamber extends outwardly from said end portion of said ceramic insulator;

a metal housing within which said end portion of said ceramic insulator is enclosed; and a ground electrode extending from said metal housing to said end of said center electrode facing said chamber to define a spark gap between said ground electrode and said end of said center electrode.

12. The spark plug as recited in claim 11 wherein said ablative coating has a thickness in a range from about 100 microns to about 1000 microns.

13. The spark plug as recited in claim 11 wherein said ablative coating has a first coefficient of thermal expansion and said ceramic insulator has a second coefficient of thermal expansion, said first coefficient being larger than said second coefficient so as to facilitate ablation of said ablative coating.

14. The spark plug as recited in claim 11 wherein said ablative coating has a first coefficient of thermal expansion and said ceramic insulator has a second coefficient of thermal expansion, said first coefficient being smaller than said second coefficient so as to facilitate ablation of said ablative coating.

15. A method for preventing misstarts of an internal combustion engine prior to sustained operation thereof, said method comprising the steps of:

coating an end of a ceramic insulator in a spark plug with an ablative coating, said ablative coating comprising a solid suspension material interdispersed in a binder material, said spark plug having a center electrode substantially enclosed within said ceramic insulator such that an end of said center electrode which faces a combustion chamber extends outwardly through said ceramic insulator, said spark plug further including a ground electrode extending from a metal housing to said end of said center electrode facing said combustion chamber to define a spark gap between said ground electrode and said chamber end of said electrode;

mounting said spark plug into said internal combustion engine; and igniting said spark plug by starting said internal combustion engine for short time intervals so as to ablate said ablative coating prior to sustained operation of said internal combustion engine.

16. The method as recited in claim 15 further comprising the step of forming said ablative coating from an aqueous mixture including:

a solid suspension material in an amount from about 65% to about 75% by weight;

a binder material in an amount from about 0.17% to about 4.4% by weight; and the balance water.

17. The method as recited in claim 16 wherein said solid suspension material is a clay material selected from the group consisting of kaolin, ball clay, bentonite, quartz, zirconia and combinations thereof.

18. The method as recited in claim 16 wherein said binder material is an ablative material selected from the group consisting of colloidal silica, colloidal alumina, methyl cellulose, polyvinyl alcohol and combinations thereof.

* * * * *